US007686406B2

(12) United States Patent
Lee

(10) Patent No.: US 7,686,406 B2
(45) Date of Patent: Mar. 30, 2010

(54) STRUCTURE FOR AUTOMATICALLY SHUTTING BASKET COVER IN REFRIGERATOR

(75) Inventor: Jae-Youl Lee, Gyeonju (KR)

(73) Assignee: LG Electronics Inc., Seoul (KR)

( * ) Notice: Subject to any disclaimer, the term of this patent is extended or adjusted under 35 U.S.C. 154(b) by 175 days.

(21) Appl. No.: 11/709,354

(22) Filed: Feb. 22, 2007

(65) Prior Publication Data

US 2007/0182296 A1 Aug. 9, 2007

Related U.S. Application Data

(63) Continuation-in-part of application No. 10/828,224, filed on Apr. 21, 2004, now abandoned.

(30) Foreign Application Priority Data

Apr. 22, 2003 (KR) ..... 2003-0025559

(51) Int. Cl.
*A47B 96/04* (2006.01)

(52) U.S. Cl. ..... 312/405.1; 312/404; 312/321.5

(58) Field of Classification Search ..... 312/298, 312/300, 309, 310, 321.5, 400, 401, 404, 312/405, 405.1
See application file for complete search history.

(56) References Cited

U.S. PATENT DOCUMENTS 2,047,996 A * 7/1936 Crosley, Jr. et al. ..... 312/405.1
2,065,116 A 12/1936 Constantine et al.
5,193,892 A * 3/1993 Swindell ..... 312/405.1
5,685,624 A 11/1997 Lee
5,765,390 A * 6/1998 Johnson et al. ..... 62/441
6,074,030 A * 6/2000 Prunty et al. ..... 312/404
6,085,542 A * 7/2000 Johnson et al. ..... 62/441
6,547,349 B2 4/2003 Sessa et al.
7,309,116 B2 * 12/2007 Garrett et al. ..... 312/405.1
2006/0061247 A1 * 3/2006 Lee et al. ..... 312/404

FOREIGN PATENT DOCUMENTS

DE 4304502 * 8/1994 ..... 312/404

* cited by examiner

*Primary Examiner*—Hanh V Tran
(74) *Attorney, Agent, or Firm*—Ked & Associates LLP

(57) ABSTRACT

A structure for automatically shutting a basket cover in a refrigerator is provided. The structure comprises an inclined portion formed at a front inner periphery of an inner case defining a storage space in a main body of the refrigerator such that a sectional area of the storage space is gradually increased toward an entrance of the storage space, a basket which is installed on a back surface of a door for and closing the storage space in order to store articles therein, and a basket cover for opening and shutting the basket, which includes a shutting-guide portion that is installed at a leading end thereof and guided along the inclined portion to shut the basket cover as the door is closed. A convenience in use of the refrigerator is enhanced and parts can be prevented from being damaged due to their interference.

12 Claims, 6 Drawing Sheets

STRUCTURE FOR AUTOMATICALLY SHUTTING BASKET COVER IN REFRIGERATOR

This application is a Continuation-In-Part of U.S. patent application Ser. No. 10/828,224, filed Apr. 21, 2004 now abandoned, which claims priority to Korean Patent Application No. 0025559/2003, filed Apr. 22, 2003, whose entire disclosures are incorporated herein by reference.

BACKGROUND OF THE INVENTION

1. Field of the Invention

The present invention relates to a refrigerator, and more particularly, to a basket cover which is provided on a back surface of a door of a refrigerator to selectively open and shut a basket for storing articles therein.

2. Description of the Prior Art

FIG. 5 is a front perspective view showing a general configuration of related art refrigerator, and FIG. 6 is a sectional view showing an essential configuration of the related art refrigerator. As shown in these figures, the interior of a main body 1 of a refrigerator is divided, by a barrier 3, into a freezing chamber 5 formed at a left side thereof and a refrigerating chamber 7 formed at a right side thereof. An inner case 2 defines an inner surface of the main body 1 of the refrigerator and includes an inclined portion 2' around a front inner periphery thereof corresponding to entrances of the freezing and refrigerating chambers 5 and 7. Due to the inclined portions 2', the freezing and refrigerating chambers 5 and 7 are formed to be expanded towards their entrances. A plurality of shelves 8 on which stored articles are placed are horizontally installed in the freezing and refrigerating chambers 5 and 7, respectively.

The freezing and refrigerating chambers 5 and 7 are separately opened and closed by doors 5' and 7', respectively. A plurality of baskets 9 are provided on the back surfaces of the doors 5' and 7'. The stored articles can be received and stored in the baskets 9, some of which are provided with a basket cover 10. In general, the basket cover 10 is made from a transparent material and rotated on a rotation center 11 formed on both ends thereof to open and close the basket 9. A handle 12 is provided at a leading end of the basket cover 10 to facilitate the opening and closing of the basket cover 10. The handle 12 has a length, a width, and a thickness. The width and thickness are substantially constant along the length thereof, as shown in FIG. 5. Reference numeral 13 indicates a hinge assembly.

However, the prior art as described above has the problems, as follows:

That is, if a user closes the door 5' or 7' in a state where the basket cover 10 has not yet been closed, the handle 12 of the basket cover 10 may interfere with the inclined portion 2' of the inner case 2 and thus be damaged due to the interference. In particular, since the refrigerator is generally installed such that the doors 5' and 7' are spontaneously closed even though the doors 5' and 7' are still opened, the user should always pay attention to the opening/shutting state of the basket cover 10.

To solve the aforementioned inconveniences, a maximum limit to which the basket cover 10 can be opened is regulated by means of a stopper or the like installed thereto. However, if such a structure is employed, the basket cover 10 cannot be opened to the utmost, so that it is inconvenient to put and take the articles into and out of the basket 9.

SUMMARY OF THE INVENTION

The present invention is conceived to solve the aforementioned problems in the prior art. Accordingly, an object of the present invention is to provide a structure for automatically shutting a basket cover when a door is closed.

Another object of the present invention is to provide a structure for allowing a basket cover not only to be automatically shut but also to be widely opened when a door of a refrigerator is closed.

According to an aspect of the present for achieving the above objects, there is provided a structure for automatically shutting a basket cover in a refrigerator, comprising an inclined portion which is formed at a front inner periphery of an inner case defining a storage space in a main body of the refrigerator such that a sectional area of the storage space is gradually increased toward an entrance of the storage space; a basket which is installed on a back surface of a door for opening and closing the storage space in order to store articles therein; and a basket cover for opening and shutting the basket, which includes a shutting-guide portion that is installed at a leading end thereof and guided along a side of the inclined portion to shut the basket cover as the door is closed.

The inclined portion may be formed at least on a front end of a ceiling portion of the storage space and cooperates with the shutting-guide portion.

Preferably, the basket cover may be formed with a laterally extending handle at the leading end thereof and is rotated on rotational pivots formed at both ends thereof for opening and shutting the basket, and the shutting-guide portion is formed on the handle.

The shutting-guide portion may be integrally formed on the handle of the basket cover to have a predetermined curvature such that an amount of protrusion of the shutting-guide portion is gradually increased as it goes from a side adjacent to a rotation center of the door towards the center thereof.

Preferably, the handle with the shutting-guide portion integrally formed thereon is shaped such that a width is relatively large at the center thereof and gradually decreased towards at least one end thereof as seen in a plan view, and the portion with a varying width is the shutting-guide portion.

According to an aspect of the present invention, there is provided a structure for automatically shutting a basket cover in a refrigerator, comprising an inclined portion which is formed at a front inner periphery of an inner case defining a storage space in a main body of the refrigerator such that a sectional area of the storage space is gradually increased towards at least a ceiling portion in an entrance of the storage space; a basket which is installed on a back surface of a door for opening and closing the storage space so as to store articles therein; a basket cover which is rotatably installed at the basket for opening and shutting the basket; and a shutting-guide portion which is provided at a side of the basket cover and guided along a side of the inclined portion to shut the basket cover as the door is closed.

The basket cover may be formed with the shutting-guide portion at a leading end thereof to extend form side to side and is rotated on rotation pivots formed at both ends thereof for opening and shutting the basket.

The shutting-guide portion may be integrally formed on the basket cover to have a predetermined curvature such that an amount of protrusion thereof is greater at the center of the basket cover that at a portion adjacent to a rotation center of the door.

According to the structure for automatically shutting the basket cover in the refrigerator configured as described above, there is an advantage in that the basket cover provided on the back surface of the door is automatically shut because the basket cover is guided along a side of the main body of the refrigerator when the user closes the door.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENTS

Hereinafter, a preferred embodiment of a structure for automatically shutting a basket cover in a refrigerator according to the present invention will be described in detail with reference to the accompanying drawings.

Figure 1:
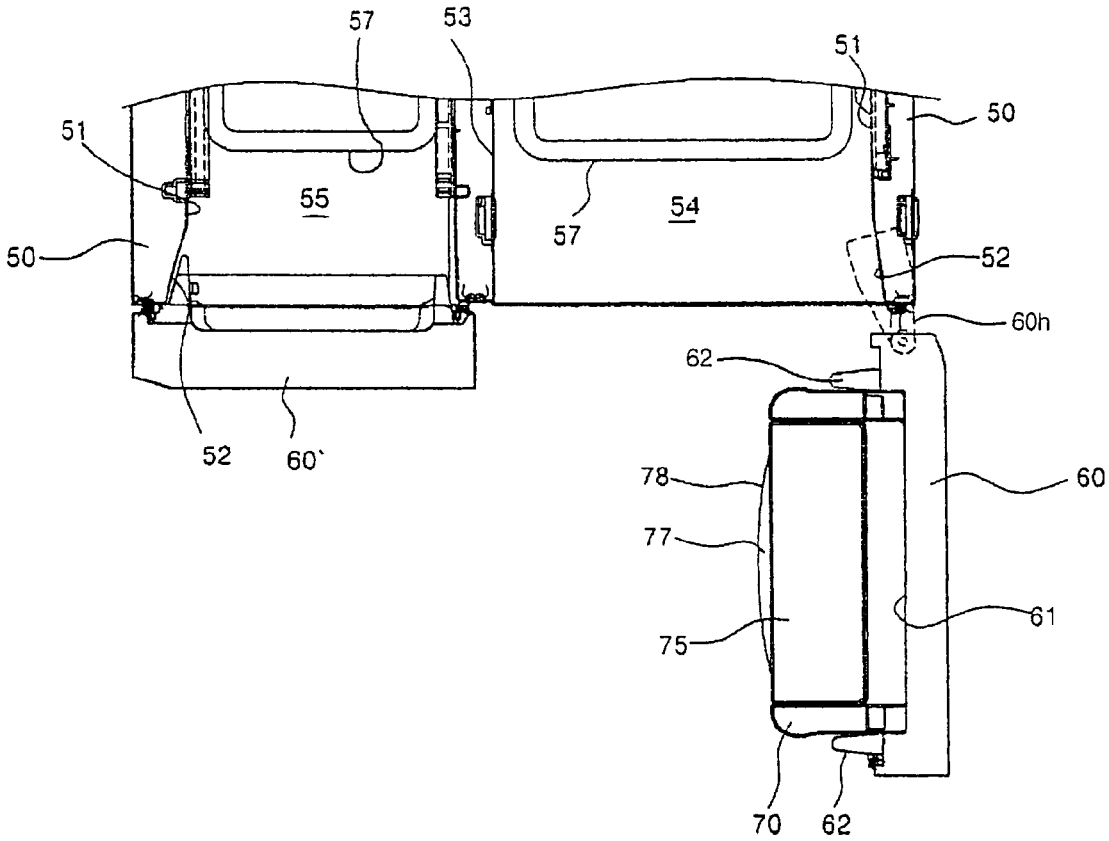
FIG. 1 is a sectional plan view showing a preferred embodiment of a structure for automatically shutting a basket cover in a refrigerator according to the present invention.
Figure 2A:
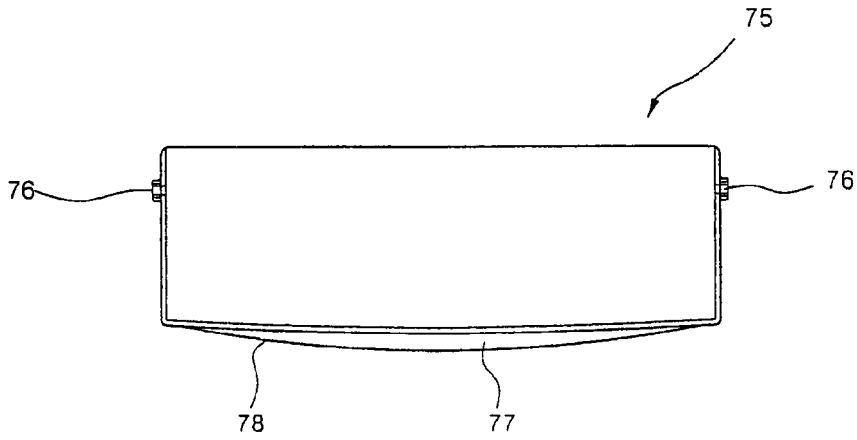
FIGS. 2*a,* 2*b* and 2*c* are plan, side and front views showing a structure of the basket cover according to the embodiment of the present invention, respectively.
Figure 3A:
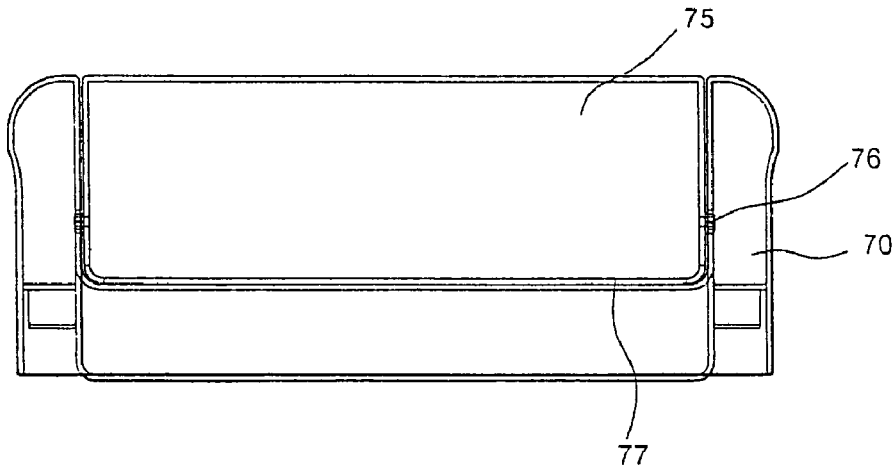
FIGS. 3*a* and 3*b* are front and side views showing a state where the basket cover of the embodiment of the present invention is installed to a basket, respectively.
Figure 3B:
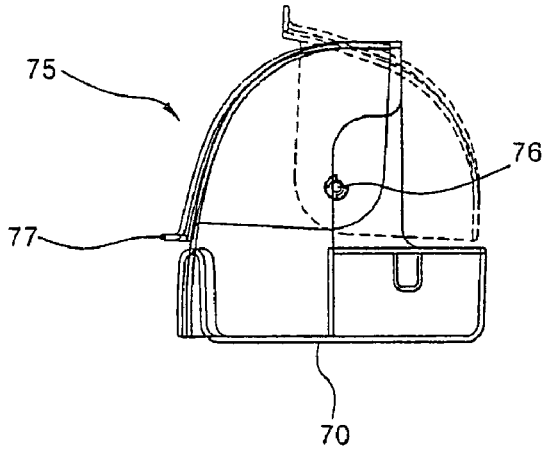

FIG. 1 is a sectional plan view showing a structure for automatically shutting a basket cover in a refrigerator according to a preferred embodiment of the present invention; FIGS. 2*a,* 2*b* and 2*c* are plane, side and front views showing a structure of a basket cover according to the embodiment of the present invention, respectively; and FIGS. 3*a* and 3*b* are front and side views showing a state where the basket cover of the embodiment of the present invention is mounted to a basket of the refrigerator.

As shown in the figures, an inner case 51 defines an inner surface of a main body 50 of the refrigerator. Thus, the inner case 51 becomes an inner surface of a storage space in the main body 50 of the refrigerator. An inclined portion 52 is formed at a front inner peripheral of the inner case 51, that is, a portion corresponding to an entrance of the storage space. In other word, the inclined portion 52 is formed along an inner periphery of the entrance of the storage space in the main body 50 of the refrigerator. Of course, the inclined portion 52 is not necessarily formed along the whole inner periphery of the entrance. In the present invention, however, the inclined portion 52 must be formed at an entrance corresponding to the ceiling of the storage space.

The storage space formed in the main body 50 of the refrigerator is generally divided into a refrigerating chamber 54 and a freezing chamber 55 by a barrier 53. The barrier 53 extends vertically within the main body 50 of the refrigerator to partition the storage space into the refrigerating chamber 54 and the freezing chamber 55. A plurality of shelves 57 are installed horizontally in the refrigerating chamber 54 and the freezing chamber 55, respectively.

The refrigerating and freezing chambers 54 and 55 are opened/closed by doors 60 and 60', respectively. Each of the doors 60 and 60' is connected and installed to one end of the main body 50 of the refrigerator through a hinge assembly 60*h* indicated by a dotted line in FIG. 1. A door liner 61 defining a back surface of the door 60 or 60' includes projections 62 formed at least vertically along both lateral ends thereof A basket 70 is installed in such a manner that both ends of the basket 70 are supported by the projections 62 of the door 60 or 60'. A number of the baskets 70 are installed horizontally on the back surface of the door 60 or 60' at predetermined vertical intervals such that articles can be stored in the baskets.

Some of the baskets 70 may include a basket cover 75 for covering the individual basket 70. It is preferred that the basket cover 75 be generally made from a transparent material so that the user can view the articles stored in the basket 70 even when the basket cover 75 is shut.

As shown well in FIGS. 2*a,* 2*b* and 2*c,* the basket cover 75 includes rotational pivots 76 that are formed at both sides thereof and then connected to corresponding sides of the basket 70. The basket cover 75 is rotated on the rotational pivots 76. Each of the rotational pivots 76 may take the shapes of a protruding rotation shaft or a through-hole. The rotational pivots 76 are aligned with a lower rear end of the basket 70.

Figure 2B:
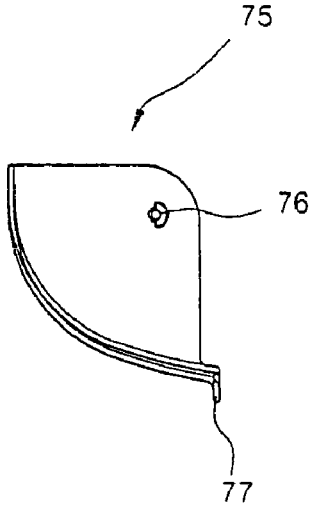
Figure 2C:
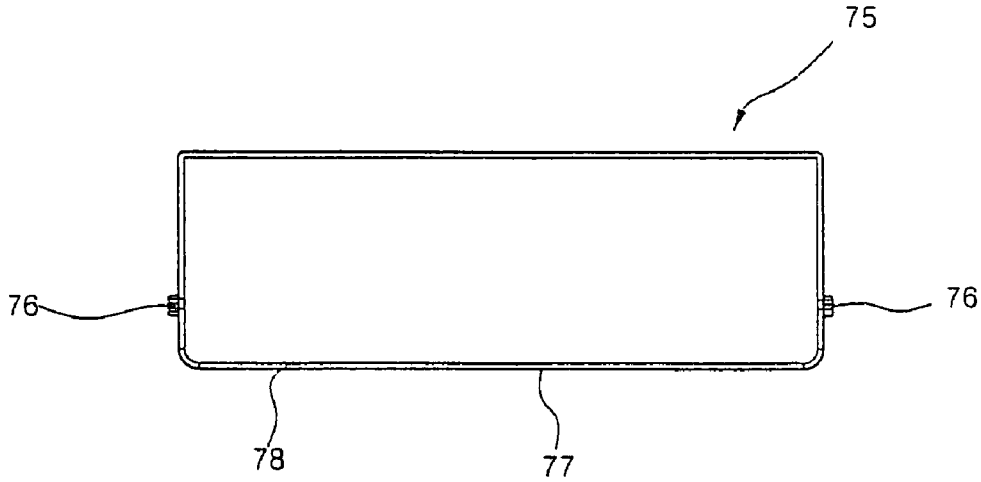

As shown in FIG. 2*b,* a shape of the basket cover 75 is a quarter circle as seen in a side view. Further, the basket 75 has a curved shape extending from side to side as seen in a plan or front view.

A handle 77 is formed at a leading end of the basket cover 75. As seen in a plan view of FIG. 2*a,* a width of the handle 77 is gradually decreased from the center to both ends thereof. The handle 77 allows the user to easily open and shut the basket cover 75.

Furthermore, a shutting-guide portion 78 is formed at one side of the handle 77, i.e., a side adjacent to the hinge assembly 60*h* that serves as a rotation center of the door 60 or 60'. The handle 77 is integrally formed with the shutting-guide portion 78 that protrudes forwardly to be inclined from the end adjacent to the hinge assembly to the center of the handle. When the door 60 or 60' is shut in a state where the basket cover 75 is opened, the shutting-guide portion 78 is guided along the inclined portion 52 corresponding to the ceiling of the storage space so that the shutting-guide portion allows the basket cover 75 to be automatically shut.

Hereinafter, an operation of the structure for automatically shutting the basket cover in the refrigerator according to the present invention constructed as described above will be described in detail.

To open and shut the basket 70, the basket cover 75 is rotated on the rotational pivots 76 while the leading end with the handle 77 formed thereon moves along a certain path. Thus, when the door 60 or 60' is opened, the user opens the basket 70 with the handle 77 and then puts or takes the articles into or out of the basket 70.

Then, the user shuts the basket cover 75 to close the basket 70. In such a state, the user can merely close the door 60 or 60'.

Of course, even though the user closes the door 60 or 60' in a state where the basket cover 75 is not shut, the basket cover 75 can be automatically shut. Such an operation will be described with reference to FIGS. 3*a,* 3*b* and 4.

When the basket cover is fully opened, the handle 77 is directed upward from the basket 70. In such a state, if the door 60 or 60' is closed to a position indicated by a solid line in FIG. 4, an end of the shutting-guide portion 78 integrally formed on the handle 77 comes into contact with the inclined portion 52 of the refrigerating or freezing chamber 54 or 55 corresponding to the storage space so that the handle 77 can be pushed. Here, the end of the shutting-guide portion 78, which protrudes to the minimum and is located adjacent to the hinge assembly 60*h*, first comes into contact with the inclined portion 52.

Figure 4:
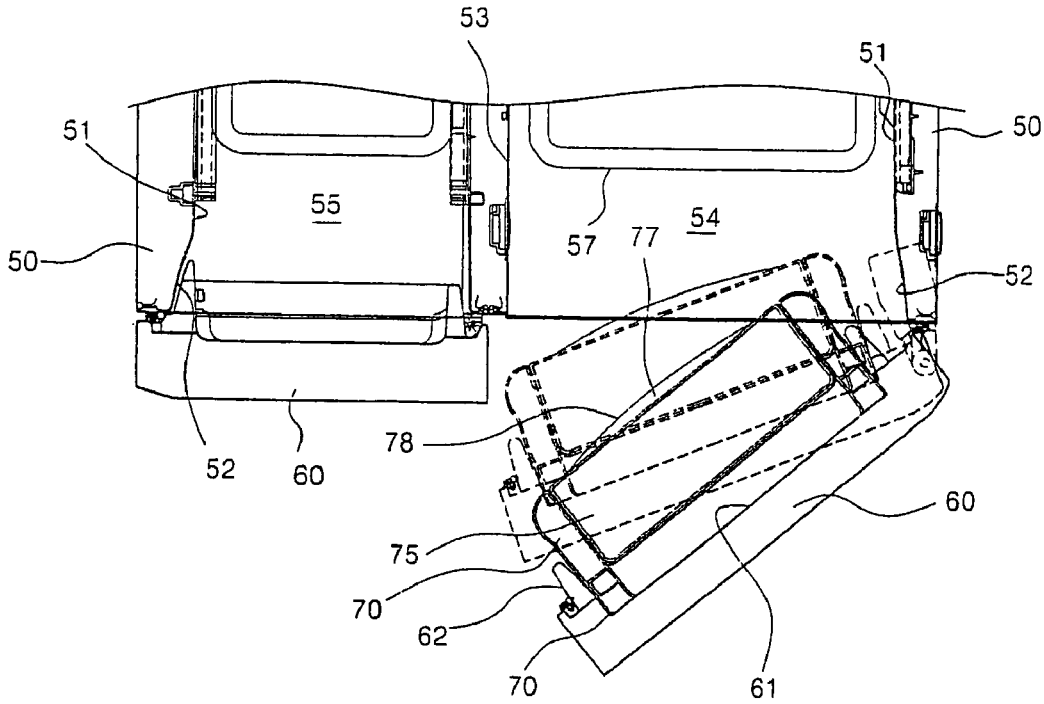
FIG. 4 is a view showing an operating state of the embodiment of the present invention.
Figure 5:
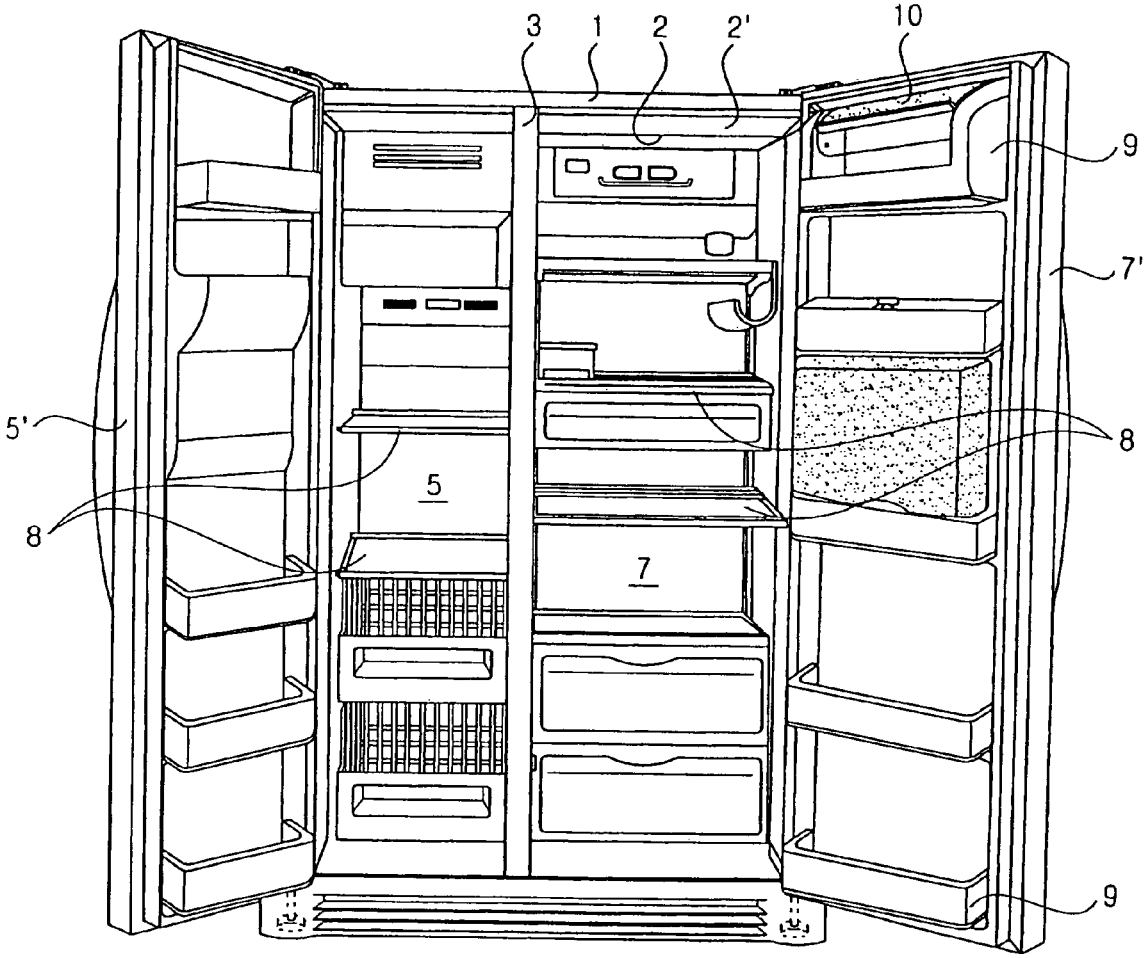
FIG. 5 RELATED ART
FIG. 5 is a front perspective view showing an inner configuration of a related art refrigerator.
Figure 6:
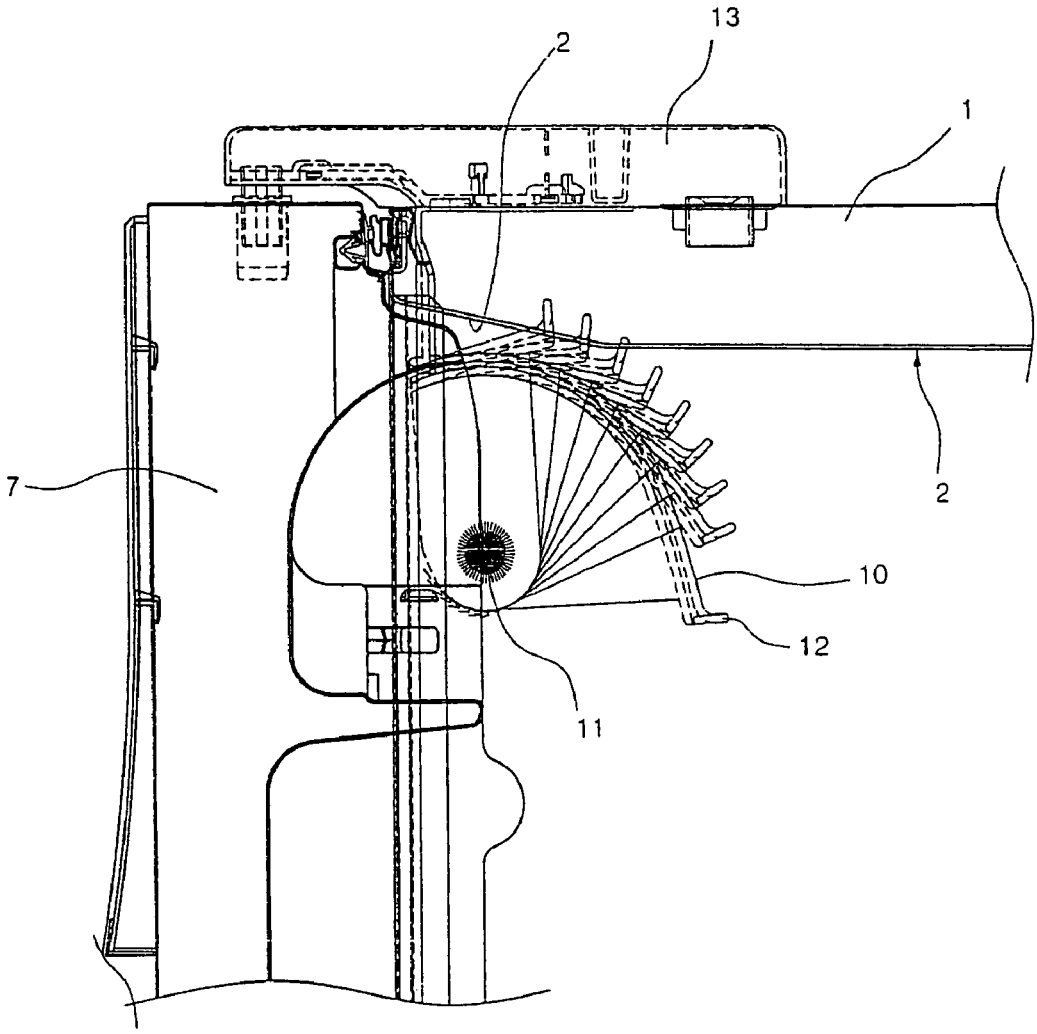
FIG. 6 RELATED ART
FIG. 6 is a sectional view showing an essential configuration of the related art refrigerator.

In addition, as indicated by a dotted line in FIG. 4, as the door 60 or 60' is further closed, a contact point of the shutting-guide portion 78 with the inclined portion 52 is shifted toward the center of the handle 77. As the contact point of the shutting-guide portion with the inclined portion 52 is shifted toward the center of the handle 77, the basket cover 75 starts to be shut by the cooperation between the shutting-guide portion 78 and the inclined portion 52. Of course, since an amount of protrusion of the shutting-guide portion 78 is gradually increased as it goes towards the center of the handle 77, a force applied to the shutting-guide portion 78 is gradually increased.

Consequently, the inclined portion 52 gradually comes into contact with the shutting-guide portion 78 by the closing operation of the door 60 or 60', and thus, the basket cover 75 can be automatically shut by the force applied to the basket cover 75 due to the contact.

According to the present invention, even though the door 60 or 60' is closed in a state where the basket cover 75 is not shut, the basket cover 75 does not interfere with the main body 50, and thus, the damage thereof does not occur.

For example, the shapes of the inclined portion 52 and the shutting-guide portion 78 need not to be restricted to those described in the embodiment of the present invention. If the inclined portion 52 and the shutting-guide portion 78 can cooperate with each other to shut the basket cover 75, they can be constructed in various manners.

Further, only the shutting-guide portion 78 may be formed on the basket cover 75 without the handle 77. That is, even though only the shutting-guide portion 78 is formed on the basket cover 75 such that a protruding width of the shutting guide portion is gradually decreased from the center of the basket cover toward the rotation center of the door 60 or 60', it may also perform a function of the handle 77.

According to the structure for automatically shutting the basket cover in the refrigerator as described above, even though the door is closed in a state where the basket cover is still opened, the basket cover and the main body of the refrigerator do not interfere with each other. Therefore, there is an advantage in that the refrigerator can be more conveniently utilized.

Further, even through the door is closed in a state where the basket cover was fully opened, the basket cover and the main body of the refrigerator do not interfere with each other. Therefore, the basket cover can be prevented from being damaged.

Furthermore, since there is no need to regulate the opening degree of the basket cover in order to prevent the basket cover from interfering with the main body of the refrigerator, the user can put or take the articles into or out of the basket while fully opening the basket. Therefore, the user can conveniently use the refrigerator.

The scope of the present invention is not limited to the embodiment as described above but defined only by the appended claims. Further, it is apparent that those skilled in the art can make various changes and modifications within the scope of the present invention set forth in the claims.

What is claimed is:

1. A refrigerator, comprising:

a main body;

a door rotatably attached to the main body;

an inclined portion formed at a front inner periphery of an inner case defining a storage space in the main body such that a sectional area of the storage space is gradually increased toward an entrance of the storage space;

a basket installed on a back surface of the door for storing articles therein, the storage space being opened and closed by the door; and a basket cover that opens and shuts the basket, the basket cover including a shutting-guide portion installed at a leading end thereof, such that, the shutting-guide portion is guided along the inclined portion to shut the basket cover when the door is closed in a state in which the basket cover is in the open position.

2. The refrigerator as claimed in claim 1, wherein the inclined portion is formed at least on a front end of a ceiling portion of the storage space and cooperates with the shutting-guide portion.

3. The refrigerator as claimed in claim 1, wherein the basket cover is formed with a laterally extending handle at the leading end thereof and is rotated on rotational pivots formed at both ends thereof to open and shut the basket, and wherein the shutting-guide portion is formed on the handle.

4. The refrigerator as claimed in claim 3, wherein the shutting-guide portion is integrally formed on the handle of the basket cover to have a predetermined curvature such that an amount of protrusion of the shutting-guide portion is gradually increased as it goes from a side adjacent to a rotation center of the door towards a center thereof.

5. The refrigerator as claimed in claim 3, wherein the handle with the shutting-guide portion integrally formed thereon is shaped such that a width is relatively large at a center thereof and gradually decreased towards at least one end thereof as seen in a plan view, and the portion with a varying width is the shutting-guide portion.

6. A refrigerator, comprising:

a main body:

a door rotatably attached to the main body:

an inclined portion formed at a front inner periphery of an inner case defining a storage space in the main body such that a sectional area of the storage space is gradually increased towards at least a ceiling portion in an entrance of the storage space;

a basket installed on a back surface of the door for storing articles therein, the storage space being opened and closed by the door;

a basket cover rotatably installed on the basket that opens and closes the basket; and a shutting-guide portion provided at a leading end of the basket cover such that the shutting-guide portion is guided along a side of the inclined portion to shut the basket cover when the door is closed in a state in which the basket cover is in the open position.

7. The refrigerator as claimed in claim 6, wherein the basket cover is formed with the shutting-guide portion at said leading end thereof to extend from side to side and is rotated on rotation pivots formed at both ends thereof to open and close the basket.

8. The refrigerator as claimed in claim 7, wherein the shutting-guide portion is integrally formed on the basket cover to have a predetermined curvature such that an amount of protrusion thereof is greater at a center of the basket cover than at a portion adjacent to a rotation center of the door.

9. A refrigerator, comprising:

a main body;

a door rotatably attached to the main body;

a basket installed on the door; and a basket cover configured to cover the basket in a closed position and provide access to the basket in an open position, wherein the basket cover includes a handle provided at a leading end thereof, such that the handle is shaped to be guided by an inclined portion of an inner case of the refrigerator to close the basket cover when the door is closed in a state in which the basket cover is in the open position.

10. The refrigerator of claim 9, wherein the handle is rounded.

11. The refrigerator of claim 10, wherein the handle protrudes at a center portion thereof.

12. The refrigerator of claim 10, wherein a width of a central portion of the handle is greater than a width of edge portions of the handle.

* * * * *